US008953987B2

(12) United States Patent
Kimura et al.

(10) Patent No.: US 8,953,987 B2
(45) Date of Patent: Feb. 10, 2015

(54) DEVELOPMENT DEVICE, AND PROCESS CARTRIDGE AND IMAGE FORMING APPARATUS INCLUDING SAME

(71) Applicants: Hideki Kimura, Kanagawa (JP); Kunihiro Ohyama, Tokyo (JP); Masayuki Yamane, Kanagawa (JP); Yoshihiro Fujiwara, Kanagawa (JP); Masaki Takahashi, Kanagawa (JP); Toshiki Hayashi, Kanagawa (JP)

(72) Inventors: Hideki Kimura, Kanagawa (JP); Kunihiro Ohyama, Tokyo (JP); Masayuki Yamane, Kanagawa (JP); Yoshihiro Fujiwara, Kanagawa (JP); Masaki Takahashi, Kanagawa (JP); Toshiki Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/482,834

(22) Filed: Sep. 10, 2014

(65) Prior Publication Data

US 2014/0376970 A1 Dec. 25, 2014

Related U.S. Application Data

(63) Continuation of application No. 13/556,433, filed on Jul. 24, 2012, now Pat. No. 8,855,536.

(30) Foreign Application Priority Data

Aug. 19, 2011 (JP) ..... 2011-179917

(51) Int. Cl.
*G03G 15/08* (2006.01)
*G03G 15/09* (2006.01)

(52) U.S. Cl.
CPC ..... *G03G 15/0865* (2013.01); *G03G 15/0887* (2013.01)
USPC ..... 399/263; 399/272

(58) Field of Classification Search
CPC ..... G03G 15/0839; G03G 15/0834; G03G 15/0896; G03G 15/0877; G03G 2215/085; G03G 2215/0827; G03G 2215/0802
USPC ..... 399/263, 272, 273, 258, 260, 256, 253
See application file for complete search history.

(56) References Cited

U.S. PATENT DOCUMENTS

2004/0022560 A1 2/2004 Hirobe et al.
2005/0244195 A1 11/2005 Hirobe et al.

(Continued)

FOREIGN PATENT DOCUMENTS

EP 1 357 443 A2 10/2003
EP 1 357 443 A3 10/2003

(Continued)

OTHER PUBLICATIONS

Combined Office Action and Search Report issued Feb. 8, 2014 in Chinese Patent Application No. 201210293584.7 (with English translation of category of Cited documents).

(Continued)

*Primary Examiner* — Billy Lactaoen

(74) *Attorney, Agent, or Firm* — Oblon, Spivak, McClelland, Maier & Neustadt, L.L.P.

(57) ABSTRACT

A development device includes a development casing, a developer bearer, a first developer conveyance member to supply developer to the developer bearer, a second developer conveyance member to transport developer axially, and a partition dividing an interior of the development casing into a supply channel and a collecting channel via which developer received from a downstream end portion of the supply channel is forwarded to an upstream end portion of the supply channel. The supply channel includes a conveyance area and a buffer area disposed adjacent to the conveyance area in a direction perpendicular to an axial direction to temporarily retain developer and midway in the developer conveyance direction inside the supply channel, and an upstream end face defining an upstream end of the buffer area is inclined relative to the axial direction to draw away from the conveyance area downstream in the developer conveyance direction.

9 Claims, 12 Drawing Sheets

(56) References Cited

U.S. PATENT DOCUMENTS

| | | | | |
|---|---|---|---|---|
| 2006/0204283 | A1 | 9/2006 | Yasuda | |
| 2010/0202805 | A1 | 8/2010 | Miyoshi et al. | |
| 2010/0329699 | A1 | 12/2010 | Ohyama et al. | |
| 2011/0008073 | A1 | 1/2011 | Kudo et al. | |
| 2011/0008075 | A1 | 1/2011 | Taguchi et al. | |
| 2011/0058857 | A1 | 3/2011 | Hori et al. | |
| 2011/0058858 | A1 | 3/2011 | Fukuda et al. | |
| 2011/0150525 | A1 | 6/2011 | Fujiwara et al. | |
| 2011/0176820 | A1 | 7/2011 | Kadota et al. | |
| 2011/0176838 | A1* | 7/2011 | Kayahara | 399/260 |
| 2011/0194874 | A1 | 8/2011 | Masuda et al. | |
| 2011/0222871 | A1 | 9/2011 | Suzuki et al. | |
| 2011/0311281 | A1 | 12/2011 | Ohyama et al. | |
| 2012/0033998 | A1 | 2/2012 | Hori et al. | |
| 2012/0051793 | A1 | 3/2012 | Kudo et al. | |
| 2012/0134702 | A1 | 5/2012 | Fujiwara | |
| 2012/0141169 | A1 | 6/2012 | Yamane et al. | |

FOREIGN PATENT DOCUMENTS

| | | |
|---|---|---|
| JP | 5-333691 | 12/1993 |
| JP | 11-202627 | 7/1999 |
| JP | 2006-251440 | 9/2006 |
| JP | 2007-047720 | 2/2007 |
| JP | 2010-164853 | 7/2010 |
| JP | 2010-197589 | 9/2010 |
| JP | 2010-244014 | 10/2010 |

OTHER PUBLICATIONS

Extended European Serach Report issued Dec. 19, 2012, in European Patent application No. 12178455.7.

* cited by examiner

DEVELOPMENT DEVICE, AND PROCESS CARTRIDGE AND IMAGE FORMING APPARATUS INCLUDING SAME

CROSS-REFERENCE TO RELATED APPLICATION

This patent application is a continuation application of U.S. application Ser. No. 13/556,433, filed Jul. 24, 2012, which is based on and claims priority pursuant to 35 U.S.C. §119 to Japanese Patent Application No. 2011-179917, filed on Aug. 19, 2011, in the Japan Patent Office; the entire contents of each of the above are hereby incorporated by reference.

FIELD OF THE INVENTION

The present invention generally relates to a development device, a process cartridge that includes a development device, and an image forming apparatus, such as a copier, a printer, a facsimile machine, or a multifunction machine having at least two of these capabilities, that includes a development device.

BACKGROUND OF THE INVENTION

Image forming apparatuses typically include a development device to develop latent images formed on a photoreceptor with developer, and two-component developer consisting essentially of toner (toner particles) and magnetic carrier (carrier particles) is widely used in image forming apparatuses. Development devices typically include a development roller or a development sleeve serving as a developer bearer and a developer conveyance member to transport the developer inside a developer conveyance channel in the development device.

Developer in the developer conveyance channel is supplied to the development sleeve, and, in a development range where the development sleeve faces a photoreceptor serving as a latent image bearer, toner in the developer is supplied to a latent image formed on the photoreceptor. Thus, the concentration of toner in the developer decreases.

Accordingly, if developer that has passed through the development range is returned to the identical developer conveyance channel from which developer is supplied (i.e., a supply channel), the concentration of toner decrease downstream in the supply channel. In particular, in images having high printing ratio, differences in the concentration of toner in developer between an upstream area and a downstream area from the development range is greater. Accordingly, it is possible that image quality is affected by the drop in the concentration of toner on the downstream side of the supply channel.

In view of the foregoing, providing multiple developer conveyance channels are proposed so that supply of developer and collection of developer that has passed through the development range can be performed in different developer conveyance channels (i.e., a supply channel and a collecting channel). The multiple developer conveyance channels are typically disposed parallel to the development sleeve.

Although such configuration is effective to inhibit the drop in the toner concentration on the downstream side of the supply channel, the amount (i.e., surface level) of developer decreases downstream in the supply channel because developer supplied from the supply channel to the development sleeve is not collected in the supply channel. Consequently, the amount of developer supplied to the development sleeve becomes uneven in the axial direction of the development sleeve. The unevenness in the amount of supplied developer can result in unevenness in image density.

To overcome such difficulties, various approaches have been tried. For example, in JP-H05-333691-A, the velocity at which developer is transported (hereinafter "developer conveyance velocity") in the supply channel is increased so that the amount of developer transported therein is greater than the amount of developer supplied to the development sleeve.

Additionally, in JP-2006-251440-A, the developer conveyance member in the supply channel is screw shaped (i.e., a supply screw), and the blade pitch of the supply screw is reduced downstream in the supply channel. As the blade pitch decreases (narrows), the distance by which developer is transported per revolution of the supply screw decreases. Accordingly, the level of developer is higher in the area where the blade pitch is shorter when the amount of developer is not changed. Accordingly, the developer conveyance velocity on the upstream side in the supply comportment is higher than that on the downstream side.

However, increasing the developer conveyance velocity on the upstream side in the supply channel can cause aggregation of developer or unevenness in the amount of developer supplied to the development roller, resulting in substandard images.

BRIEF SUMMARY OF THE INVENTION

In view of the foregoing, one embodiment of the present invention provide a development device to develop a latent image formed on a latent image bearer with developer. The development device includes a development casing for containing developer, a developer bearer disposed facing a latent image bearer through an opening formed in the development casing, to carry by rotation developer to a development range facing the latent image bearer, a first developer conveyance member to supply developer to the developer bearer while transporting the developer axially, a second developer conveyance member to transport developer axially, and a partition dividing an interior of the development casing into a supply channel and a collecting channel via which developer received from a downstream end portion of the supply channel is forwarded to an upstream end portion of the supply channel. The supply channel includes a conveyance area in which the developer receives conveyance force directly from the first developer conveyance member, and a buffer area adjacent to the conveyance area in a direction perpendicular to an axial direction of the first developer conveyance member to temporarily retain developer supplied to the developer bearer. In the buffer area, developer does not receive conveyance force directly from the first developer conveyance member. The buffer area is positioned midway inside the supply channel in the developer conveyance direction, and an upstream end face defining an upstream end of the buffer area is inclined relative to the axial direction of the first developer conveyance member to draw away from the conveyance area downstream in the developer conveyance direction.

Another embodiment provides a process cartridge that is removably installed in an image forming apparatus and includes at least the latent image bearer, the development device described above, and a common unit casing to house the latent image bearer and the development device.

Yet another embodiment provides an image forming apparatus that includes the latent image bearer, a charging unit to charge a surface of the latent image bearer, a latent image forming device to form a latent image on the latent image bearer, and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
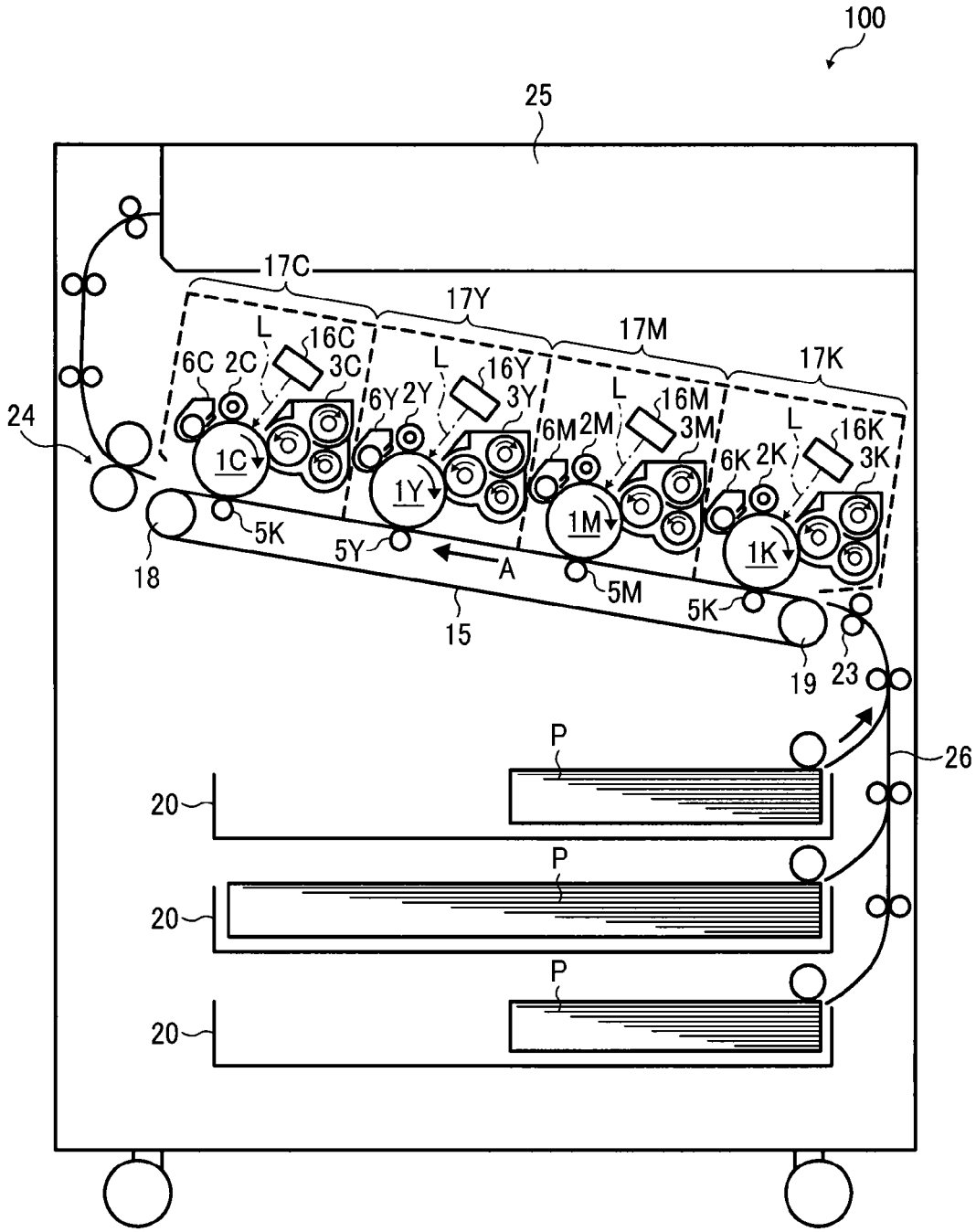
FIG. 1 is a schematic diagram of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic diagram illustrates a configuration of an image forming apparatus 100 that in the present embodiment is a printer. The image forming apparatus 100 is a tandem-type multicolor image forming apparatus and includes four image forming units 17K, 17M, 17Y, and 17C for forming black (K), magenta (M), yellow (Y), and cyan (C) single-color toner images, respectively. An endless transfer-transport belt 15 winding around support rollers 18 and 19 is provided beneath the image forming units 17. An upper side of the transfer-transport belt 15 rotates in a direction indicated by arrow A shown in FIG. 1 (hereinafter "belt travel direction") while carrying a sheet P (recording medium) thereon. Transfer bias rollers 5K, 5M, 5Y, 5C are provided facing the respective image forming units 17K, 17M, 17Y, and 17C via the transfer-transport belt 15.

The image forming units 17 can be configured into a process cartridge or modular unit removably installed in an apparatus body of the image forming apparatus 100.

The image forming apparatus 100 further includes a fixing device 24, disposed downstream from the downstream support roller 18 in the belt travel direction, and a discharge tray 25 formed on an upper side of the main body of the image forming apparatus 100. The fixing device 24 fixes a toner image on the sheet P thereon after the sheet P is separated from the transfer-transport belt 15, after which the sheet P is discharged onto the discharge tray 25.

The image forming apparatus 100 further includes multiple sheets cassettes 20 each containing multiple sheets P, a feed unit 26 to feed the sheets P from the sheets cassettes 20 to the image forming units 17, and a pair of registration rollers 23. The registration rollers 23 forward the sheet P sent from one of the sheet cassettes 20, timed to coincide with image formation by the image forming units 17.

It is to be noted that, in the configuration shown in FIG. 1, the transfer-transport belt 15 is disposed obliquely to reduce the width of the image forming apparatus 100, that is, its lateral length in FIG. 1, and accordingly the belt travel direction indicated by arrow A is oblique. With this configuration, the width of the image forming apparatus 100 can be only a length slightly greater than the length of A3 sheets in their longitudinal direction. In other words, the width of the image forming apparatus 100 can be significantly reduced to a length only necessary to contain sheets.

Each image forming unit 17 includes a drum-shaped photoreceptor 1 serving as a latent image bearer. Around the photoreceptor 1, a charging unit 2 to charge a surface of the photoreceptor 1, a development device 3 to develop an electrostatic latent image formed on the photoreceptor 1, and a cleaning unit 6 to clean the surface of the photoreceptor 1 are provided. An exposure unit 16 serving as a latent image forming device directs writing light (such as a writing beam) L onto the surface of each photoreceptor 1 between the charging unit 2 and the development device 3. Thus, each image forming unit 17 has a known configuration. As the photoreceptor 1, belt-shaped photoreceptors may be used instead of drum-shaped photoreceptors.

In the above-described image forming apparatus 100, when users instruct the apparatus to start image formation, each image forming unit 17 starts to form a single-color toner image. More specifically, in each image forming unit 17, the photoreceptor 1 is rotated by a main motor and is charged uniformly at a position facing the charging unit 2 as the charging process. Then, the exposure unit 16 directs the writing beam L onto the photoreceptor 1 according to yellow, cyan, magenta, or black image data decomposed from multicolor image data, thus forming an electrostatic latent image thereon. The latent image is then developed by the development device 3. Thus, single-color toner images are formed on the respective photoreceptors 1. While the processes described above are performed, the sheets P are fed one by one from one of the sheet cassettes 20 by the feed unit 26 to the registration rollers 23, which forward the sheet P to the transfer-transport belt 15, timed to coincide with the arrival of the toner images formed on the respective photoreceptors 1. Then, the transfer-transport belt 15 transports the sheet P to the respective transfer positions.

When the surface of each photoreceptor 1 carrying the toner image reaches a position facing the transfer bias roller 5 via the transfer-transport belt 15, the toner image is transferred by the bias applied by the transfer bias roller 5 from the photoreceptor 1 onto the sheet P on the transfer-transport belt 15. Thus, the black, magenta, yellow, and cyan toner images are sequentially transferred from the respective photoreceptors 1 and superimposed one on another on the sheet P, forming a multicolor toner image on the sheet P. The sheet P on which the multicolor toner image is formed is then separated from the transfer-transport belt 15, and the fixing device 24 fixes the image on the sheet, after which the sheet P is discharged onto the discharge tray 25.

After the toner image is transferred from each photoreceptor 1, the cleaning unit 6 removes any toner remaining thereon, and a discharge lamp removes electrical potentials remaining on the photoreceptor 1 as required. Then, the charging unit 2 again charges the surface of the photoreceptor 1.

Although the image forming units 17K, 17M, 17Y, and 17C are arranged in that order in the belt travel direction in the configuration shown in FIG. 1, the order of arrangement is not limited thereto. For example, the image forming unit 17K for black may be disposed extreme downstream in the belt travel direction, and the image forming units 17M, 17Y, and 17C may be disposed in that order upstream from the image forming unit 17K.

The image forming units 17 are described in further detail below. The image forming units 17 have a similar configuration except that the colors of the toner used in the development devices 3 are different.

Figure 2:
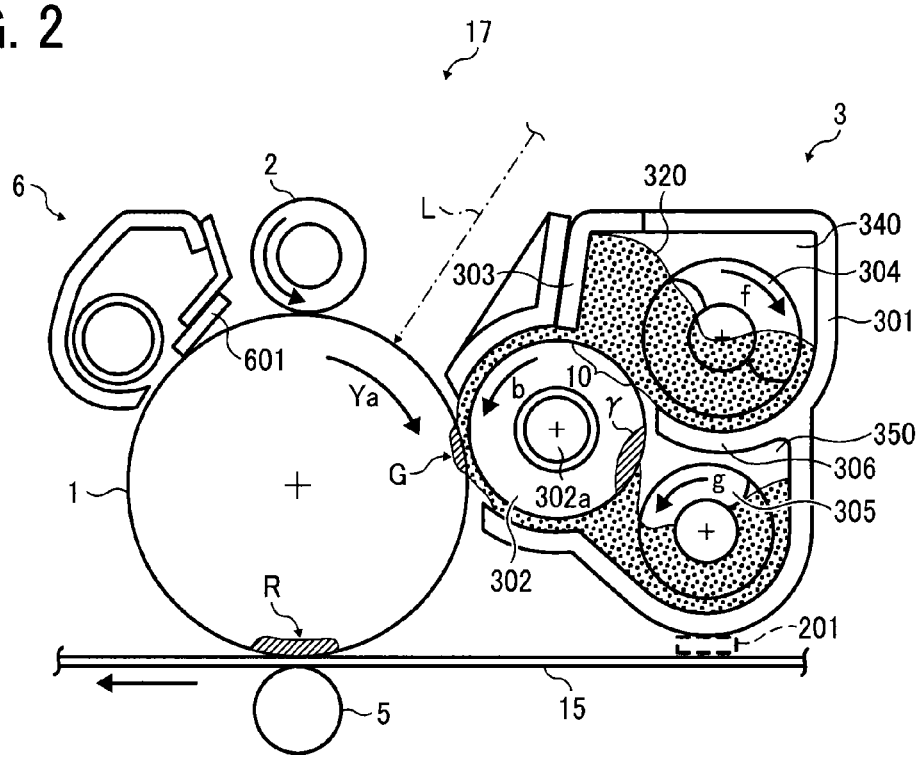
FIG. 2 is a schematic end-on axial view of an image forming unit.

FIG. 2 is a schematic end-on axial view of the image forming unit 17 including the development device 3 usable in the image forming apparatus 100 in the present embodiment.

The development device 3 is disposed facing the photoreceptor 1 that rotates clockwise, that is, in the direction indicated by arrow Ya, in FIG. 2. The charging unit 2 is positioned above the photoreceptor 1, substantially at twelve o'clock of the photoreceptor 1 in FIG. 2. Although the charging unit 2 in the present embodiment is a rotary body rotating at an identical velocity to that of the photoreceptor 1, alternatively, a corona discharge-type charger may be used.

After the charging unit 2 charges the circumferential surface of the photoreceptor 1 uniformly in the dark, the exposure unit 16 directs the optical beam L to the photoreceptor 1, thus forming an electrostatic latent image thereon. As the photoreceptor 1 rotates, the electrostatic latent image formed thereon moves downstream to the development device 3, which is on the right of the photoreceptor 1 in the configuration shown in FIG. 2.

The development device 3 includes a development casing 301 serving as a developer container for containing developer 320, a development roller 302, first and second developer conveyance members 304 and 305 to agitate the developer 320, and a developer regulator 303. The interior of the development casing 301 is divided by a partition 306 at least partly into a supply channel 340 and a collecting channel 350 (i.e., developer conveyance channels), where the first and second developer conveyance members 304 and 305 (hereinafter also "the supply screw 304 and the collecting screw 305") are provided, respectively.

It is to be noted that, in FIG. 2, reference numeral 10 represents an attraction area or pump-up area of the development roller 302 onto which developer supplied by the supply screw 304 is brought up, and 201 represents a toner concentration detector. Further, reference character 302*a* represents a stationary shaft of the development roller, and γ represents a separation range.

The development roller 302 serving as a developer bearer is adjacent to the photoreceptor 1 at a position between two o'clock to three o'clock of the photoreceptor 1 in FIG. 2, and thus a development range G is formed therebetween. An opening is formed in the development casing 301 at the position facing the photoreceptor 1, exposing the development roller 302. As the development roller 302 rotates in the direction indicated by arrow b shown in FIG. 2, the developer 320 contained in the development casing 301 is carried on the surface of the development roller 302 and transported to the development range G. In the development range G, toner in the developer 320 adheres to the electrostatic latent image formed on the surface of the photoreceptor 1, thus developing it into a toner image.

As the photoreceptor 1 rotates, the toner image further moves downstream in the direction of rotation of the photoreceptor 1 to a transfer area R facing the transfer bias roller 5. The transfer bias roller 5 is positioned beneath the photoreceptor 1 at six o'clock of the photoreceptor 1 in FIG. 2. Although the transfer mechanism of the present embodiment uses rotators, namely, the transfer bias rollers 5, alternatively, a corona discharge-type transfer mechanism may be used.

In the transfer area R, the toner image is transferred from the photoreceptor 1 onto the sheet P. In the present embodiment, the toner image formed on the photoreceptor 1 is transferred directly to the sheet P. It is to be noted that the development device according to the present embodiment can adapt to intermediate transfer-type image forming apparatuses that primarily transfer toner images from the photoreceptors and superimpose them one on another on an intermediate transfer member (such as intermediate transfer belt), forming a multicolor toner image, after which the superimposed toner image is transferred onto a sheet at a time. In this case, the toner image formed on the photoreceptor 1 is transferred onto the intermediate transfer member in the transfer area R.

Subsequently, the surface of the photoreceptor 1 that has passed through the transfer area R reaches a position facing the cleaning unit 6 as the photoreceptor 1 rotates. The cleaning unit 6 is positioned at ten o'clock of the photoreceptor 1 in FIG. 2. The cleaning unit 6 includes a cleaning blade 601 for removing any toner remaining on the circumferential surface of the photoreceptor 1 after the toner image is transferred therefrom onto the sheet P in the transfer area R. The circumferential surface of the photoreceptor 1 that has passed through the range facing the cleaning unit 6 is again charged by the charging unit 2 uniformly. Then, image formation is repeated.

Next, the development device 3 is described in further detail below.

Figure 3:
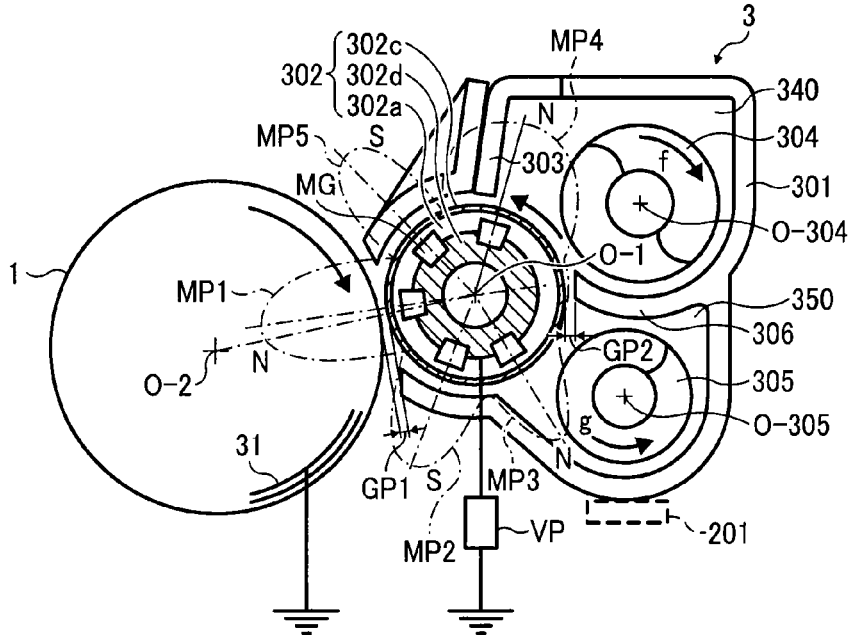
FIG. 3 is an end-on axial view of the development device and a photoreceptor, and distribution of magnetic flux density in normal direction is superimposed on it.
Figure 4:
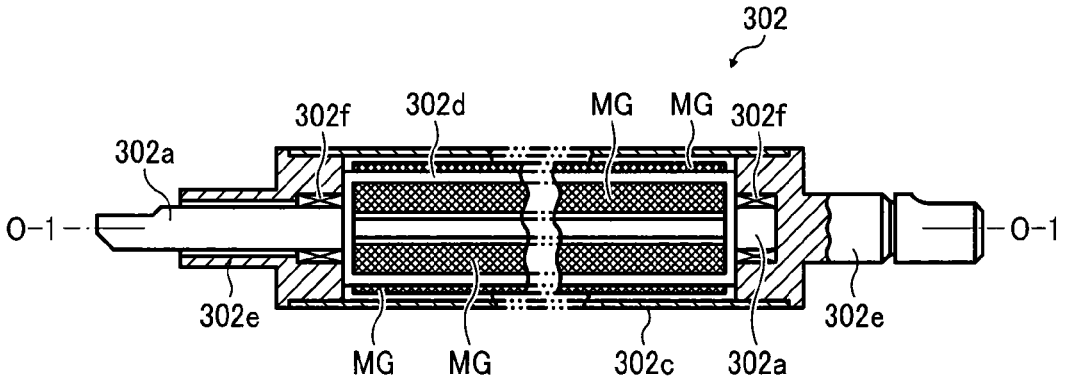
FIG. 4 is a cross-sectional view of a development roller in parallel to its axis.

FIG. 3 is an end-on axial view of the development device 3 and the photoreceptor 1, and distribution of magnetic flux density in normal direction formed around the development roller 302 is superimposed on it. FIG. 4 is a cross-sectional view of the development roller 302 in parallel to its rotary axis. It is to be noted that the terms "upstream" and "downstream" in the description below mean those in the direction in which developer is transported (hereinafter "developer conveyance direction") unless otherwise specified.

In the present embodiment, the supply screw 304 and the collecting screw 305 are, for example, conveyance screws each including a rotary shaft and a spiral-shaped blade winding around the rotary shaft to transport developer axially by rotation. The external diameter of the spiral blade is smaller than about 16 mm, for example. The development roller 302 used in the present embodiment have a diameter of 14 mm or smaller to make the development device 3 compact.

Referring to FIG. 3, a magnet roller 302*d* is provided inside the development roller 302, and its position is fixed relative to the development device 3. A cylindrical sleeve 302*c* provided outside the magnet roller 302*d* rotates together with a rotary shaft 302*e*. The sleeve 302*c* is formed of nonmagnetic metal such as aluminum although other materials may be included therein. The stationary shaft 302*a* of the development roller 302 is fixed to the development casing 301, the cylindrical magnet roller 302*d* is united to the stationary shaft 302*a*, and the rotary shaft 302*e* is united to the sleeve 302*c* overlaying the magnet roller 302*d* across a gap.

The magnet roller 302*d* includes multiple magnets MG arranged at predetermined intervals in the circumferential direction and fixed to an outer circumferential surface of the magnet roller 302*d*. The magnets MG of the magnet roller 302*d* form magnetic fields to cause the developer 320 to stand on end on the circumferential surface of the sleeve 302*c* and to separate the developer 320 from the sleeve 302*c*. The magnetic carrier particles gather along the magnetic force lines in normal direction generated by the magnets MG, forming magnetic brushes.

For example, the magnet roller 302*d* in the present embodiment includes five magnets MG positioned inside the sleeve 302*c* and generates five magnetic poles MP1 through MP5 (magnetic distribution) as shown in FIG. 3 although other configuration can be adopted. It is to be noted that, in FIG. 3, only one of the multiple magnets provided in the magnet roller 302*d* is given the reference character "MG" for simplicity.

The magnet roller 302*d* is fixed to a stationary member such as the development casing 301 so that the magnets MG face predetermined directions. The sleeve 302*c* is designed to rotate around the magnets MG. As the sleeve 302*c* rotates around the magnet roller 302*d*, the developer 320 is attracted to the magnets MG and carried by the sleeve 302*c*.

As shown in FIG. 3, one of the magnets MG is positioned on the line passing through the center of rotation O-1 of the development roller 302 as well as a center of rotation O-2 of the photoreceptor 1 and faces the photoreceptor 1. Thus, the magnet MG forms the development pole MP1 in the development range G, that is, the development pole MP1 faces the photoreceptor 1. Other magnets MG are arranged to generate the magnetic pole MP2 facing the development casing 301, the magnetic pole (collecting pole) MP3 facing the collecting screw 305, the magnetic pole (regulation pole) MP4 facing the developer regulator 303, and the magnetic pole (conveyance pole) MP5 arranged in that order counterclockwise from the development pole MP1.

Although polarities of the magnetic poles MP1 through MP5 are north (N), south (S), N, N, and S counterclockwise from the development pole MP1, the polarities may be reversed. On the development roller 302 shown in FIG. 3, centers of the magnetic poles MP1, MP2, MP3, and MP4 are substantially at eight o'clock, seven o'clock, five o'clock, and one o'clock, respectively.

In the development range G, the development roller 302 is not in direct contact with the photoreceptor 1, and a development gap GP1 having a predetermined distance suitable for image development is kept between the development roller 302 and the photoreceptor 1.

Developer particles are caused to stand on end on the circumferential surface of the development roller 302 and brought into contact with the surface of the photoreceptor 1. Thus, toner particles can adhere to the electrostatic latent image formed thereon, developing the latent image.

Referring to FIG. 3, a grounded power source VP for generating development bias is connected to the stationary shaft 302*a*. The rotary shaft 302*e* is rotatable relative to the stationary shaft 302*a* via bearings 302*f* (shown in FIG. 4), driven by a driving unit. Voltage from the power source VP connected to the stationary shaft 302*a* is applied via the electroconductive bearings 302*f* and the electroconductive rotary shaft 302*e* to the sleeve 302*c*. By contrast, as shown in FIG. 3, an electroconductive support body 31 that forms an innermost layer of the photoreceptor 1 is grounded.

Thus, an electrical field for conveying toner particles separated from carrier particles toward the photoreceptor 1 is formed in the development range G, and accordingly the toner particles move toward the photoreceptor 1 due to differences in electrical potential between the sleeve 302*c* and the electrostatic latent image formed on the surface of the photoreceptor 1.

The development device 3 according to the present embodiment is usable in image forming apparatuses that involve an exposure process using optical writing light L. More specifically, the charging unit 2 shown in FIG. 2 charges the photoreceptor 1 uniformly to a negative electrical potential, and the portion on which an image is to be formed (i.e., an image portion) is exposed to the writing light L so as to reduce the amount of optical writing. Then, the image portion, that is, an electrostatic latent image, that has a reduced electrical potential is developed with toner particles whose polarity is negative, which is a method so-called "reversal development". It is to be noted that charging potentials of the photoreceptor 1 can be either negative or positive in configurations to which the features of this specification are applicable.

After image development, developer carried on the sleeve 302*c* is conveyed downstream and collected in the development casing 301 due to magnetic force exerted by the magnetic pole MP2.

The collecting pole MP3 and the regulation pole MP4 positioned downstream from the magnetic pole MP2 in the direction of rotation of the sleeve 302*c* have the same polarity. Therefore, no magnetic field for causing the developer 320 to stand on end is formed between the collecting pole MP3 and the regulation pole MP4 in the direction of rotation of the sleeve 302*c*, thus facilitating separation of the developer 320 that has been attracted to the sleeve 302*c* from the development roller 302. As shown in FIG. 3, in the range between the collecting pole MP3 and the regulation pole MP4, the peak of distribution of magnetic flux density in normal direction is significantly lower than that in other ranges. Thus, this range serves as the developer separation range γ (shown in FIG. 2) to separate the developer 320 from the sleeve 302*c*.

The concentration of toner in developer decreases after the toner therein moves to the photoreceptor 1. Therefore, desired image density might not be attained if such developer 320 having a reduced toner concentration is not separated from the development roller 302 but is transported again to the development range G (hereinafter "carryover of developer") and used in image development.

To prevent carryover of developer, the developer 320 is separated from the development roller 302 in the developer separation range γ and agitated in the development casing 301 so that the developer has a desired toner concentration and a desired amount of electrical charges. After the concentration of toner therein and charge amount are adjusted, the developer is brought up by the regulation pole MP4 onto the development roller 302 in the attraction area 10 facing the regulation pole MP4.

While the developer 320 passes by the developer regulator 303 positioned immediately downstream from the peak position of the regulation pole MP4, the amount of the developer 320 carried by the magnetic force exerted by the regulation pole MP4 on the development roller 302 is adjusted, after which the developer 320 is transported to the development area G. The conveyance pole MP5 positioned between the regulation pole MP4 and the development pole MP1 exerts magnetic force for conveying the developer 320 from the developer regulator 303 to the development pole MP1.

Figure 5A:
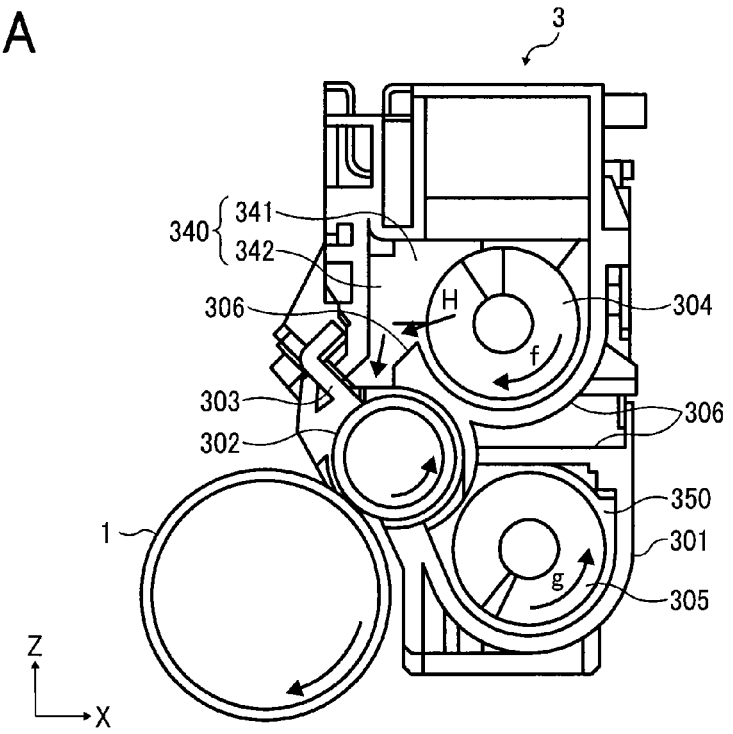
FIG. 5A is an end-on axial view of a development device according to an embodiment.
Figure 5B:
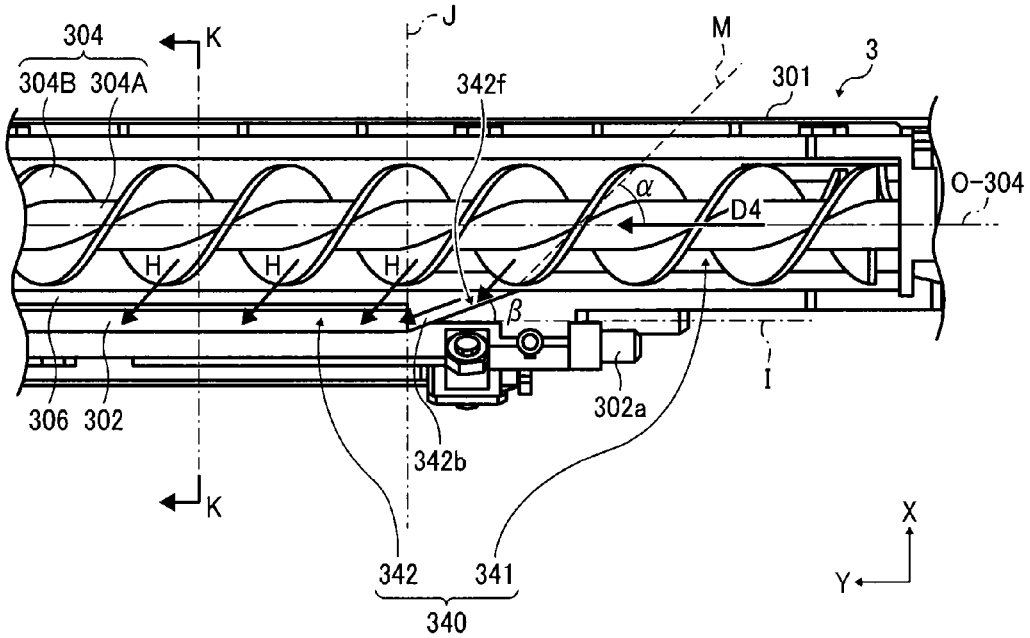
FIG. 5B is an enlarged plan view illustrating an upstream end portion of a supply channel.

Referring to FIGS. 5A and 5B, distinctive features of the present embodiment are described below. It is to be noted that, in FIG. 5B, reference character 304A represents the rotary shaft of the supply screw 304, and 304B represents the spiral blade of the supply screw 304.

Referring to FIG. 5A, inside the supply channel 340, an area in which the supply screw 304 exerts conveyance force is referred to as a conveyance area 341, and another area that does not receive conveyance force from the supply screw 304 and is adjacent to the conveyance area 341 is referred to as a buffer area 342. Developer supplied to the development roller 302 is retained in the buffer area 342. The buffer area 342 can extend from a midway position inside the supply channel 340 downstream in the developer conveyance direction and can overlap with the development roller 302 entirely in the longitudinal direction of the development roller 302. While supplying developer from the conveyance area 341 to the buffer area 342 as indicated by arrow H shown in FIGS. 5A and 5B, the supply screw 304 transports developer inside the conveyance area 341 downstream as indicated by arrow D4 shown in FIG. 5B.

Further, in the present embodiment, as shown in FIG. 5B, an inner wall of the development casing 301 that defines an upstream end of the buffer area 342 (hereinafter "upstream end face 342*f*") is inclined in a horizontal direction relative to the axial direction (indicated by broken line I in FIG. 5B, hereinafter "axial direction I") of the supply screw 304. The buffer area 342 is described in further detail later with reference to FIGS. 10 to 12.

It is to be noted that, in FIG. 5B, reference character 342*b* represents a bottom face of an upstream end portion of the buffer area 342 in the developer conveyance direction indicated by D4 shown in FIG. 5A, α represents an angle of twist of the spiral blade 304B of the supply screw 304, and β represents an inclination of the upstream end face 342*f* relative to the axial direction I.

Flow of the developer 320 in the development device 3 is described below.

Figure 6:
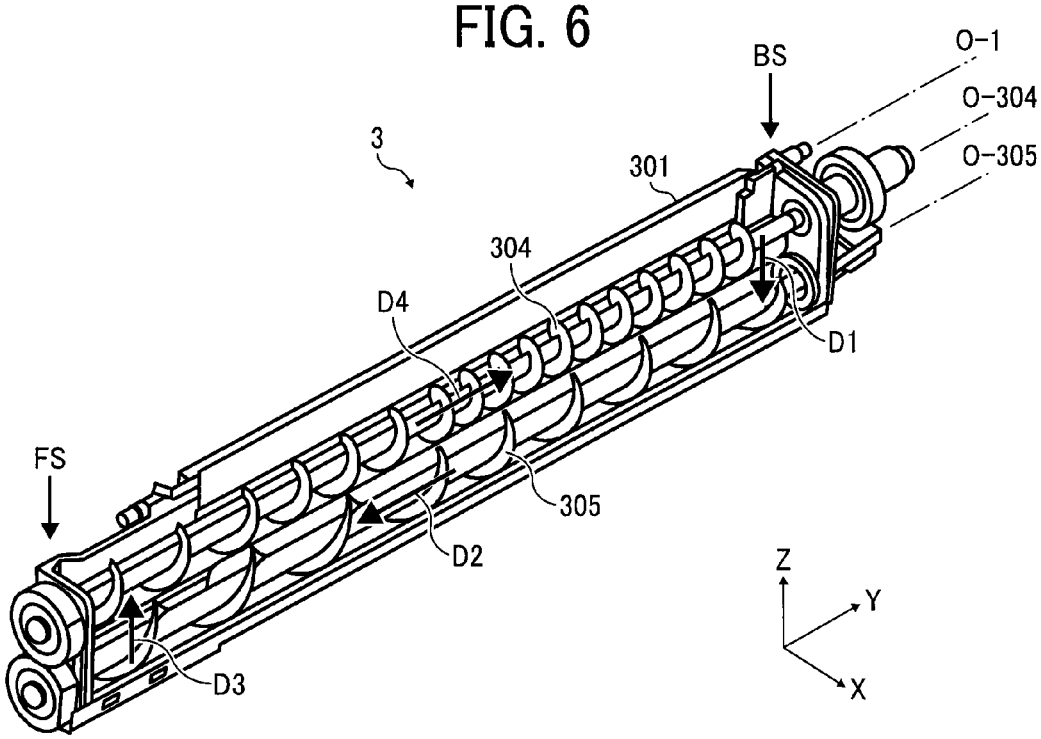
FIG. 6 is a perspective view illustrating an interior of the development device.
Figure 7:
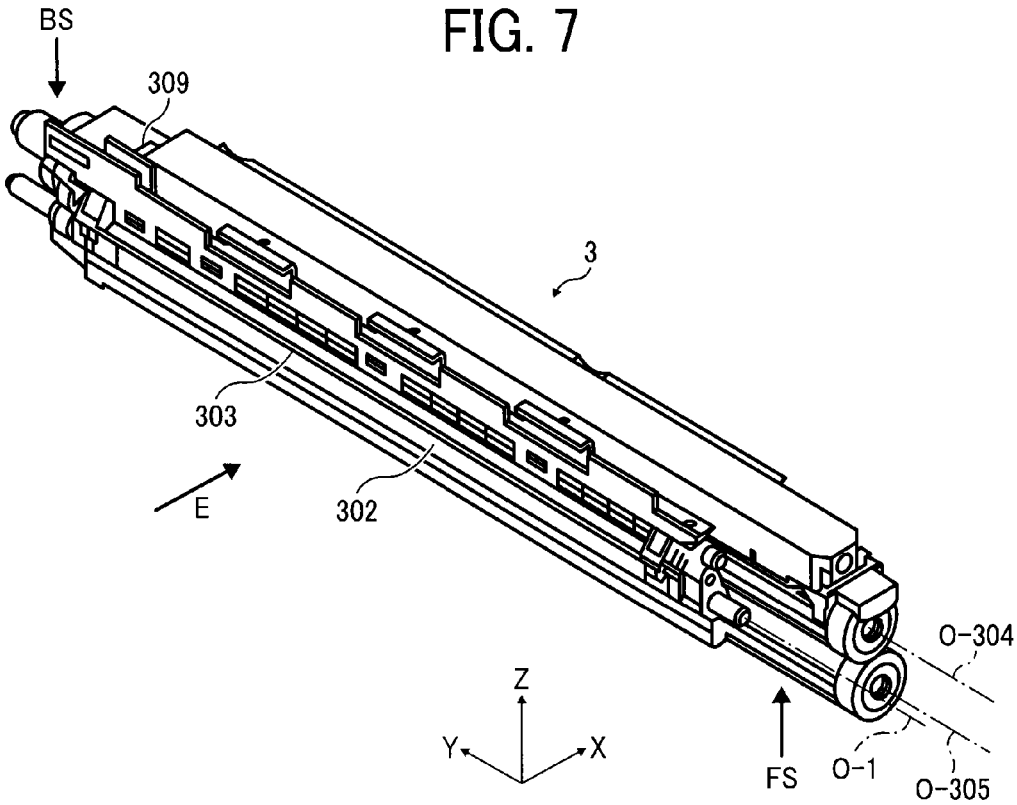
FIG. 7 is a perspective view illustrating an exterior of the development device.

FIG. 6 is a perspective view that illustrates an interior of the development device 3, and FIG. 7 is a perspective view that illustrates an exterior of the development device 3. It is to be noted that arrows D1 to D4 shown in FIG. 6 represent flow of the developer 320 in the development casing 301, and reference numeral 309 represents a toner supply inlet.

The supply screw 304 is positioned adjacent to and upstream from the development roller 302 in the direction of rotation of the development roller 302, at two o'clock of the development roller 302 in FIGS. 2 and 3. The supply screw 304 rotates clockwise as indicated by arrow f shown in FIGS. 2 and 3 around the center of rotation O-304 parallel to the center of rotation O-1 of the development roller 302.

Referring to FIG. 7, with this rotation, the developer 320 is transported from a proximal side FS to a distal side BS in the longitudinal direction of the development device 3 along the center of rotation (centerline) O-304 as indicated by arrow D4. The supply screw 304 transports the developer 320 axially from the proximal side FS to the distal side BS when a driving force is inputted to the rotary shaft thereof.

The collecting screw 305 is positioned adjacent to the development roller 302 and at four o'clock of the development roller 302 in FIGS. 2 and 3. The collecting screw 305 is adjacent to the developer separation range γ. The collecting screw 305 rotates counterclockwise as indicated by arrow g shown in FIGS. 2 and 3 around the center of rotation O-305 parallel to the center of rotation O-1 of the development roller 302. With this rotation, the developer 320 is transported from the distal side BS to the proximal side FS in the longitudinal direction of the development device 3 along the center of rotation (centerline) O-305 as indicated by arrow D2. When a driving force is inputted to the rotary shaft thereof, the collecting screw 305 transports the developer 320 axially from the distal side BS to the proximal side FS in the direction opposite the direction in which the supply screw 304 transports the developer 320.

Inside the development casing 301, the supply channel 340, in which the supply screw 304 is provided, is positioned above and adjacent to the collecting channel 350, in which the collecting screw 305 is provided, via the partition 306 supported inside the development casing 301.

As shown in FIGS. 6 and 7, the supply screw 304 and the collecting screw 305 slightly project beyond the end of the development roller 302 on the proximal side FS to secure supply of the developer 320 from the supply channel 340 to the proximal end portion of the development roller 302. Additionally, the developer conveyance members 304 and 305 extend beyond the end of the development roller 302 on the distal side BS to provide a space necessary for toner supply. The longitudinal length of the developer regulator 303 is determined in accordance with the length of the development roller 302.

Figure 8:
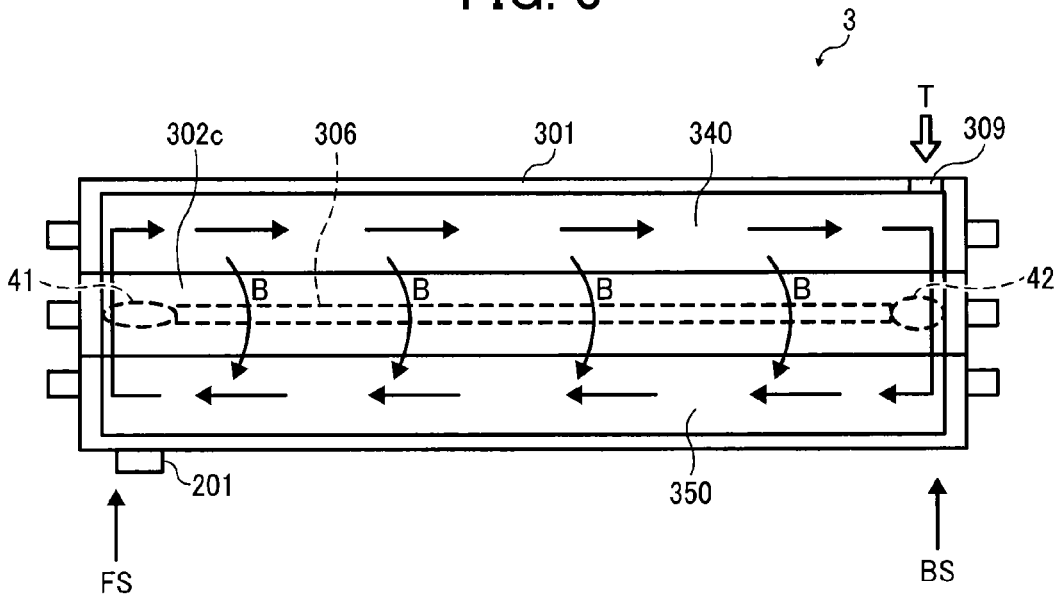
FIG. 8 illustrates flow of developer in a developer container in the development device.
Figure 9:
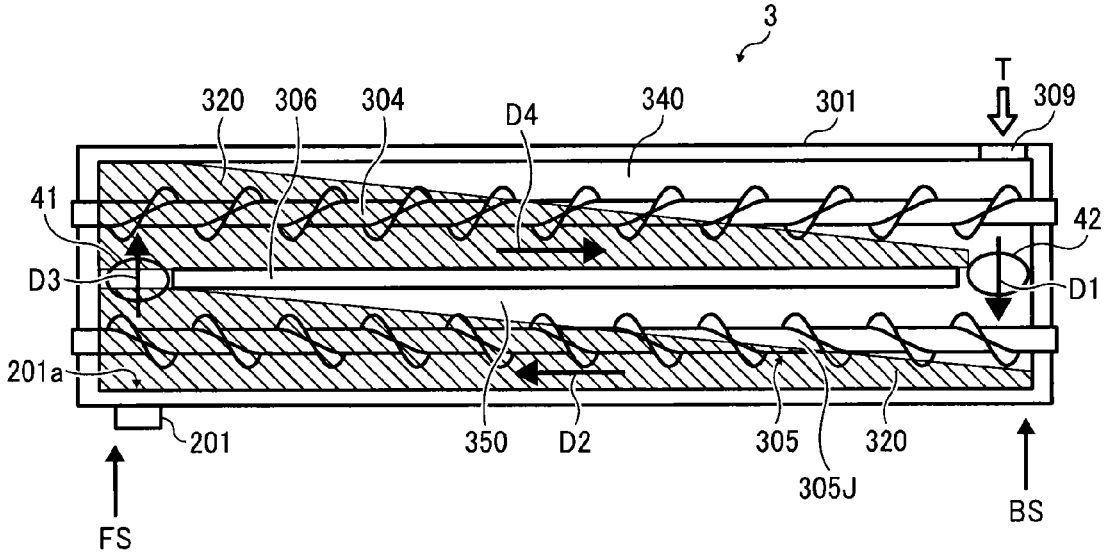
FIG. 9 illustrates a cross section of the development device parallel to an axial direction.

FIG. 8 is a plan view inside the development casing 301 as viewed in the direction indicated by arrow E shown in FIG. 7. FIG. 9 is a cross-sectional view illustrating a configuration adjacent to the axis of rotation of the supply screw 304 as viewed in the direction indicated by arrow E in FIG. 7. It is to be noted that reference character 305J shown in FIG. 9 represents the rotary shaft of the collecting screw 305.

Referring to FIGS. 8 and 9, openings 41 and 42 are formed in the respective longitudinal end portions of the partition 306, forming the communication portions. The developer 320 transported by the collecting screw 305 from the distal side BS to the proximal side FS is piled against the side wall of the development casing 301 in the downstream end portion in that direction and then brought up through the opening 41 (hereinafter also "developer-lifting opening 41") formed in the proximal end portion of the partition 306 to the supply channel 340 as indicated by arrow D3.

In the supply channel 340, the developer 320 transported by the supply screw 304 from the proximal side FS to the distal side BS as indicated by arrow D4 is piled against the side wall of the development casing 301 in the downstream end portion in that direction (distal side BS) similarly, and then falls through the opening 42 (hereinafter also "developer-falling opening 42") formed in the distal end portion of the partition 306 to the collecting channel 350 as indicated by arrow D1.

Next, supply of toner is described below with reference to FIGS. 8 and 9.

Toner in the developer 320 contained in the development device 3 is consumed in image development. Accordingly toner is externally supplied to the developer 320 in the development device 3 through the toner supply inlet 309 positioned adjacent to the end portion of the development device 3 on the distal side BS as indicated by arrow T shown in FIGS. 8 and 9.

The distal end portion of the development device 3 corresponds to the downstream end portion of the supply channel 340 from which the developer is supplied to the development roller 302. Accordingly, the supplied toner is not immediately supplied to image development but can move from the supply channel 340 through the developer-falling opening 42 to the collecting channel 350.

The collecting channel 350 including the collecting screw 305 is for collecting the developer 320 separated from the development roller 302 and transporting it. The developer 320 is not supplied from the collecting channel 350 to the development roller 302. Therefore, the supplied toner fallen through the developer-falling opening 42 to the collecting channel 350 is transported by the collecting screw 305 to the proximal side FS as indicated by arrow D2 while being mixed with the developer 320 separated from the development roller 302. While being transported to the downstream end portion of the collecting channel 350, which is on the proximal side FS of the development device 3, the mixture of supplied toner and developer 320 in which the concentration of toner is reduced can be adjusted to have a proper toner concentration. Therefore, insufficiently agitated developer including fresh toner supplied through the toner supply inlet 309 is not supplied to image development. That is, developer in which the concentration of toner is uneven is not supplied.

Then, the developer 320 is transported from the collecting channel 340 through the developer-lifting opening 41 to the supply channel 340. In the supply channel 340, the supply screw 304 supplies the developer 320 to the development roller 302 while transporting it to the distal side BS of the development device 3 as indicated by arrow D4.

Thus, in the present embodiment, since the supply channel 340 is divided from the collecting channel 350 by the partition 306, the developer 320 that has been used in image development, having a reduced toner concentration, is not immediately supplied to the development roller 302 but is agitated by the collecting screw 305. Accordingly, only the developer 320 having a desired toner concentration and including toner with a desired charge amount can be supplied to the development roller 302 and used in image development. Thus, both compactness in the horizontal direction and high image quality can be attained.

Additionally, the toner concentration detector 201 is provided to a bottom portion of the development device 3. The toner concentration detector 201 according to the present embodiment is a magnetic permeability detector and can detect the concentration of carrier in developer. The concentration of toner in the developer can be obtained by deducting the concentration of carrier from 100. Based on the concentration of carrier, a controller judges whether the concentration of toner above the toner concentration detector 201 is appropriate and decides the amount of toner supplied.

Disposing the toner concentration detector 201 adjacent to the downstream end of the collecting screw 305 can attain the following advantage.

Developer in the supply channel 340 is supplied to the development roller 302 and collected in the collecting channel 350 while being transported by the supply screw 304 to the distal side BS. Accordingly, in the collecting channel 350, developer tends to accumulate in the downstream end portion in the developer conveyance direction of the collecting screw 305 (on the proximal side FS). Therefore, when the toner concentration detector 201 is disposed adjacent to the downstream end of the collecting screw 305 where the amount of developer is sufficient, detection of the concentration of carrier therein is reliable.

Additionally, in the present embodiment, the two developer conveyance members 304 and 305 are arranged one above the other on a side of the development roller 302 as shown in FIGS. 2 and 3. This arrangement is advantageous over a comparative development device 3Z shown in FIG. 17 in that the lateral size of the development device 3 can be reduced.

Figure 17:
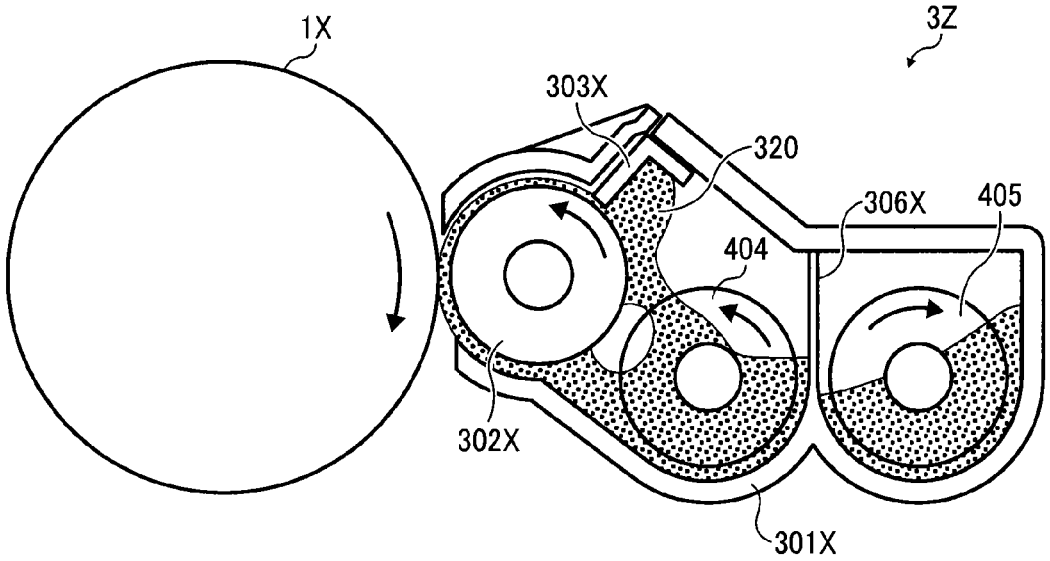
FIG. 17 is a development device in which two developer conveyance members are arranged in a direction away from a development roller.

Specifically, in the comparative development device 3Z shown in FIG. 17, two developer conveyance members, namely, a supply screw 404 and a collecting screw 405, are arranged horizontally in a direction away from a development roller 302X. It is to be noted that components of the comparative development device 3Z similar to those of the development device 3 according to the present embodiment are given identical reference numeral and a suffix "X", and descriptions thereof are omitted.

Additionally, in the present embodiment, the collecting screw 305 may include multiple blades extending from the shaft 305J (shown in FIG. 9) in the normal direction of the collecting screw 305, instead of the screw blade, in the range facing the developer-lifting opening 41. As the collecting screw 305 rotates, the multiple blades can flip up developer from beneath the developer-lifting opening 41, thus facilitating movement of developer from the collecting channel 350 to the supply channel 340.

Next, distinctive features of the present embodiment are described in comparison to a development device 3X according to a comparative example.

Figure 16A:
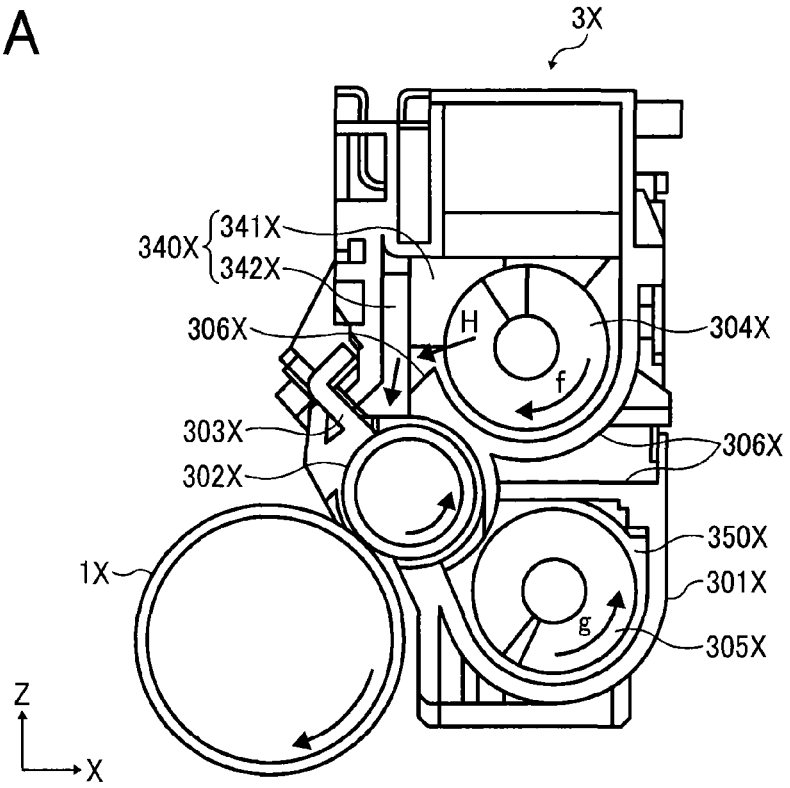
FIG. 16A is a cross-sectional view of a development device according to a comparative example.
Figure 16B:
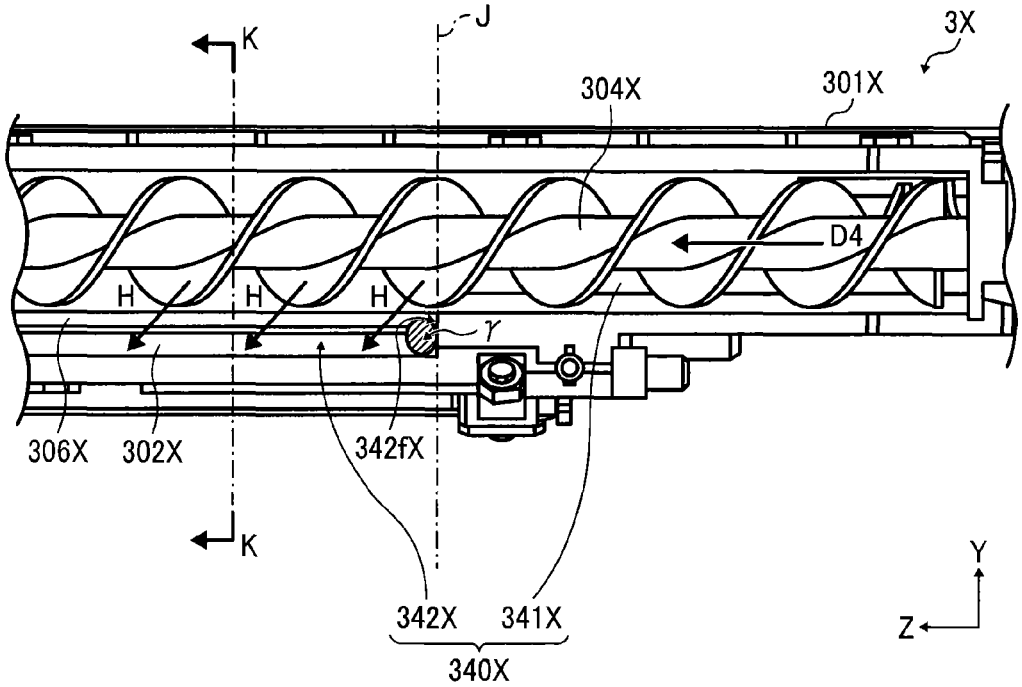
FIG. 16B is an enlarged plan view illustrating an upstream end portion of a supply channel in the configuration shown in FIG. 16A.

FIG. 16A is a cross-sectional view of the comparative development device 3X, and FIG. 16B is an enlarged plan view illustrating the upstream end portion of the supply channel FIG. 16A illustrates a cross section along line K-K shown in FIG. 16B.

The development device 3X shown in FIGS. 16A and 16B includes two developer conveyance channels, namely, a supply channel 340X and a collecting channel or circulation channel 350×. The supply channel 340X is above the circulation channel 350X. Arrows D4 and H in FIGS. 16A and 16B indicate movement of developer. A supply screw 304X transports developer in the supply channel 340X from the right to the left in FIG. 16B as indicated by arrow D4.

As shown in FIGS. 16A and 16B, the supply channel 340X can be divided into a conveyance area 341X in which the supply screw 304X exerts conveyance force and a buffer area 342X in which developer supplied to a development roller 302X is retained. While supplying developer from the conveyance area 341X to the buffer area 342X as indicated by arrow H shown in FIGS. 16A and 16B, the supply screw 304X transports developer inside the conveyance area 341X downstream as indicated by arrow D4 shown in FIG. 16B.

In the development device 3X, the developer is retained in the downstream end portion of the collecting channel 350X (circulation channel) and sent to the supply channel 340X, being pushed up by developer transported from the upstream side of the collecting channel 350X. Since the bulk of the developer is greater adjacent to the downstream end of the collecting channel 350X, it is possible that developer inside the collecting channel 350X adheres to the development roller 302X if the collecting channel 350X faces the development roller 302X at that position. To prevent this inconvenience, in the development device 3X, the downstream end portion of the collecting channel 350X is disposed outside the axial end of the development roller 302X. Accordingly, the upstream end portion of the supply channel 340X communicating with the downstream end portion of the collecting channel 350X is also disposed outside the axial end of the development roller 302X as shown in FIG. 16B.

In the development device 3X shown in FIG. 16B, an area of the supply channel 340X upstream from line J includes only the conveyance area 341X, and an area downstream from the line J includes the conveyance area 341X and the buffer area 342X. That is, the buffer area 342X extends entirely in the longitudinal length of the development roller 302X and above the development roller 302X.

On the downstream side from the line J, developer is supplied from the conveyance area 341X to the buffer area 342X as the supply screw 304X rotates. At that time, since the supply screw 304X transports the developer axially, naturally the direction of developer supplied from the conveyance area 341X to the buffer area 342X is not perpendicular to the axial direction of the supply screw 304X (parallel to arrow D4) but oblique thereto as indicated by arrow H shown in FIGS. 16A and 16B.

As shown in FIG. 16B, if an upstream end face 342*f*X that is an inner wall of the development casing 301 defining the upstream end of the buffer area 342X is perpendicular to the axial direction of the supply screw 304X, developer in an area γ is not likely to move. Therefore, in the area γ that is extreme upstream in the buffer area 342X, the developer is not likely to flow from the conveyance area 341X and the amount of developer supplied becomes in sufficient.

Even if developer is supplied, developer can be retained and coagulate in the area γ because movement of the developer is small. Coagulated developer is not likely to fall from the buffer area 342X to the development roller 302X. Accordingly, supply of developer to the development roller 302X can become insufficient. If coagulated developer in the buffer area 342X increases in size and cannot pass through the regulation gap, facing the developer regulator 303X, the amount of developer pumped up to the development roller 302X becomes insufficient. Thus, developer can be partly absent, creating white lines in output images.

In particular, if developer conveyance velocity is faster in the upstream end portion of the supply channel 340X so prevent shortage of developer in the downstream end portion of the supply channel 340X, the area γ increases in length to the downstream side, thus increasing the possibility of creation of white lines caused by coagulated developer.

This phenomenon is not limited to configurations in which developer conveyance velocity is faster in the upstream end portion of the supply channel 340X but can occur in development devices in which developer is supplied from the conveyance area 341X to the buffer area 342X midway in conveyance in the supply channel 340X.

In view of the foregoing, the development device 3 according to the present embodiment is configured as follows.

Figure 10:
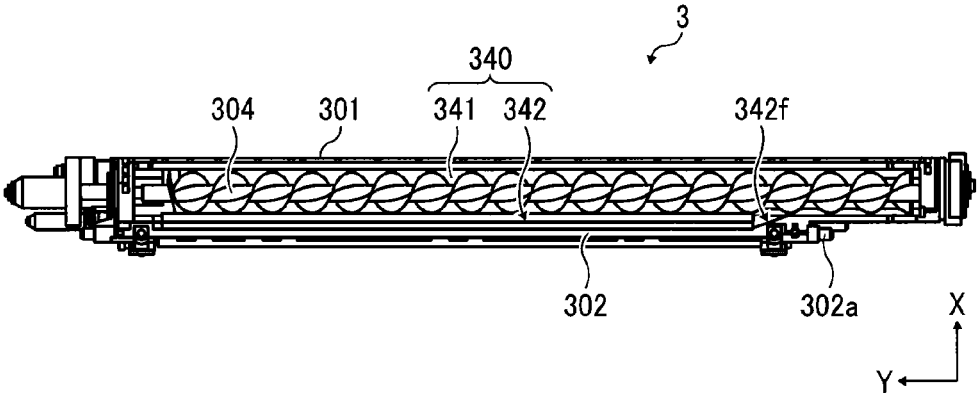
FIG. 10 is a plan view of the development device, and an upper casing of the supply channel is removed.
Figure 11:
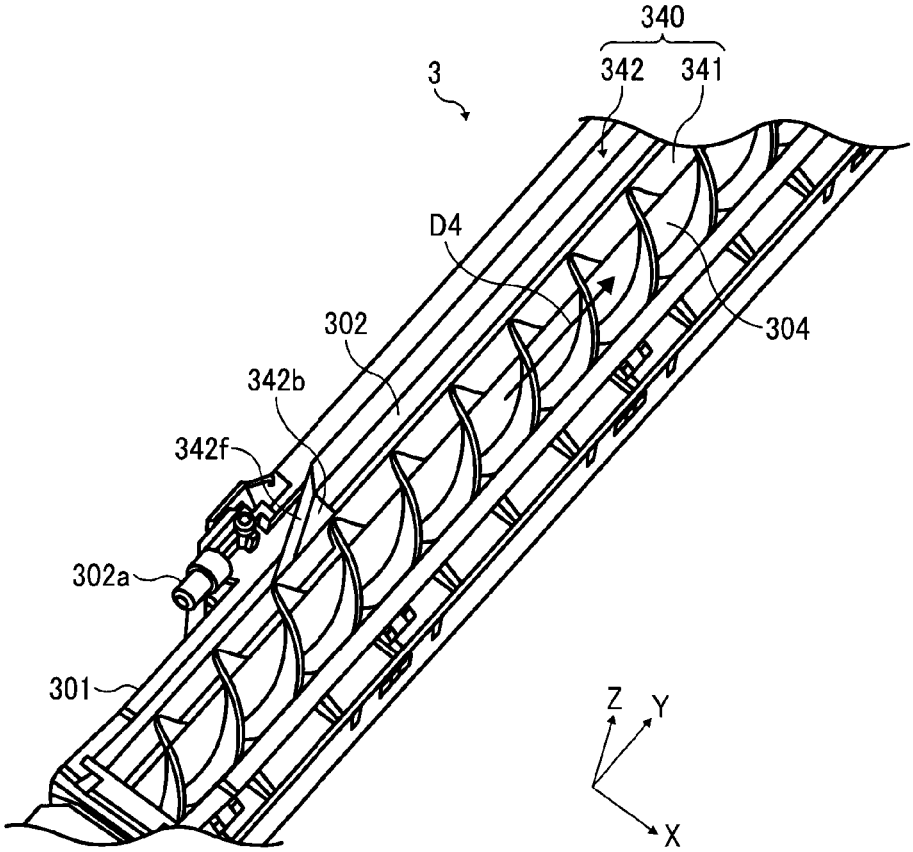
FIG. 11 is an enlarged perspective view illustrating the upstream end portion of the supply channel.
Figure 12:
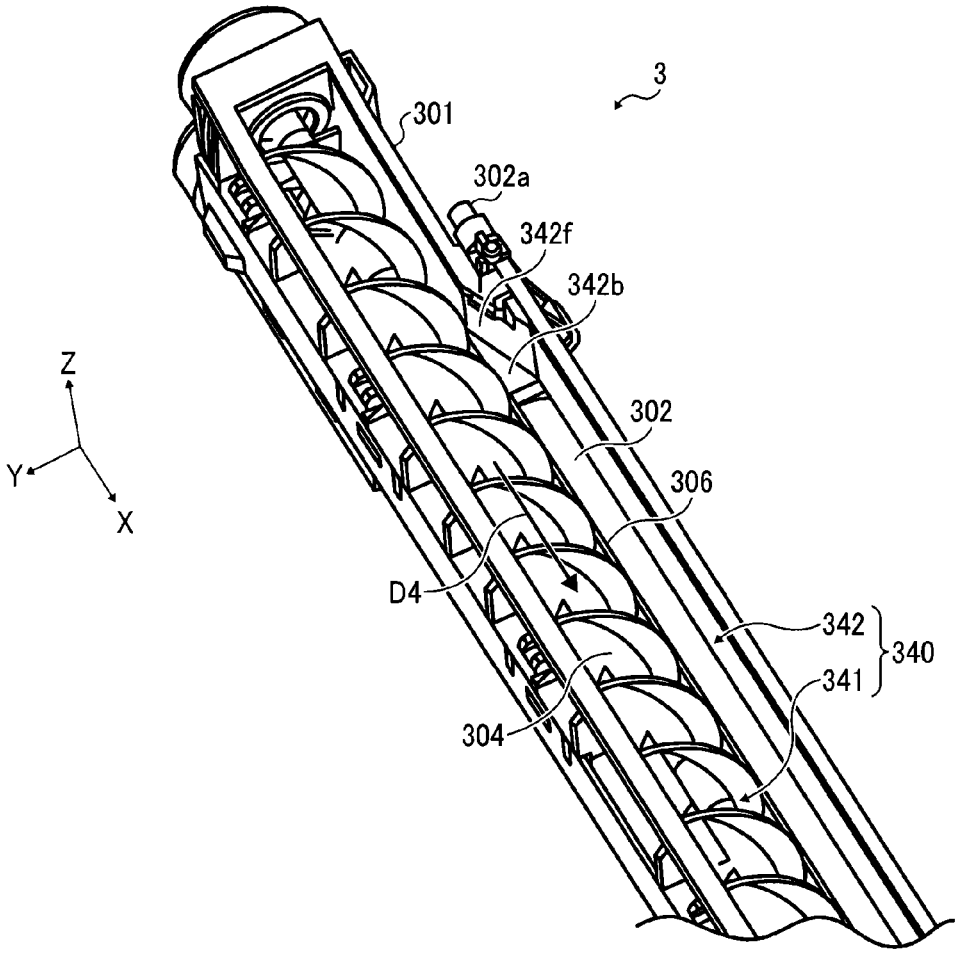
FIG. 12 is an enlarged perspective view illustrating the upstream end portion of the supply channel from a different angle.

FIG. 10 is a plan view of the development device 3, and an upper casing of the supply channel 340 is removed. FIG. 11 is an enlarged perspective view illustrating the upstream end portion of the supply channel 340, and FIG. 12 is an enlarged perspective view illustrating the upstream end portion of the supply channel 340 from a different angle.

Differently from the comparative development device 3X, in the development device 3 according to the present embodiment, the upstream end face 342*f* (shown in FIGS. 5B, 11, and 12) that defines the upstream end of the buffer area 342 is inclined relative to the axial direction I (shown in FIG. 5B) of the supply screw 304 such that the upstream end face 342*f* draws away from the conveyance area 341 toward the downstream end in the developer conveyance direction indicated by arrow D4 shown in FIG. 5B.

Additionally, referring to FIG. 5B, the upstream end face 342*f* can be a flat tapered face, and the angle β formed by the upstream end face 342*f* (i.e., tapered face) and the axial direction I (i.e., inclination of the tapered upstream end face 342*f* relative to the axial direction I) is smaller than the angle of twist α of the spiral blade 304B of the supply screw 304.

It is to be noted that the term "angle of twist α" used here means an angle formed by the center of rotation O-304 and a line M tangential to the spiral blade 304B of the supply screw 304 at the position where the spiral blade 304B crosses the center of rotation O-304 when the supply screw 304 is viewed from a position vertically above it.

If the joint between the conveyance area 341 and the buffer area 342 is square (such as, at right angle) or the inclination of the tapered face is extremely small, conveyance of developer is inhibited on the downstream side of (and adjacent to) the square portion in the developer conveyance direction indicated by arrow D4. Accordingly, developer can accumulate and further agglomerate, which causes shortage of developer pumped up to the development roller 302. As a result, white lines appear on output images. To eliminate such inconveniences, in the development device 3 according to the present embodiment, the joint between the conveyance area 341 and the buffer area 342 is not square but tapered, thus facilitating the flow of developer. Additionally, as described above with reference to FIG. 5B, the angle β of the upstream end face 342*f* (i.e., tapered face) is smaller than the angle of twist α of the supply screw 304 not to inhibit the flow of developer.

As the supply screw 304 rotates in the direction indicated by arrow f shown in FIG. 5A, the supply screw 304 can scoop developer out of the supply channel 340 onto the development sleeve 302*c*. Thus, the amount of developer supplied to the development sleeve 302*c* can be greater compared with a case in which the supply screw 304 rotates in the opposite direction.

The developer supplied from the supply channel 340 passes through the development range, after which the developer leaves the development roller 302 and is not returned to the supply channel 340 but collected in the collecting channel 350. Thus, supply and collection of developer are performed in different developer conveyance channels. Specifically, developer supplied to the development roller 302 is always provided from the supply channel 340. The developer that has once passed through the development range is not supplied to the development roller 302 until it is mixed with supplied toner in the collecting channel 350 and then is forwarded to the supply channel 340. With this configuration, the concentration of toner in the developer supplied to the development roller 302 can be kept constant, and image density can be constant in the longitudinal direction of the development roller 302.

For example, the supply screw 304 can be a screw having two spiral blades 304B (i.e., a double-helix screw). Double-helix screws can attain a higher efficiency in conveyance of developer than single-helix screws having a single spiral blade. Although developer conveyance efficiency attained by single-helix screws can be enhanced by increasing the screw pitch or rotational frequency, if the screw pitch is excessively large, the angle of the blade relative to the rotary shaft decreases (blade leans down), and efficiency in conveyance of developer in the axial direction decreases. In this case, the angle of twist $\alpha$ decreases, and accordingly it is necessary to further reduce the angle $\beta$ of the tapered face (upstream end face 342*f*) relative to the axial direction. Since conveyance force exerted on the developer on the tapered face is smaller, if an area (tapered area) facing the upstream end face 342*f* is expanded, it is disadvantageous in terms of conveyance force in the axial direction, and developer tends to accumulate in the tapered area.

Additionally, increasing the rotational frequency is disadvantageous because it causes temperature to rise.

By contrast, when the supply screw 304 has multiple helices, the number of spiral blades 304B for conveying developer increases, thus enhancing developer conveyance efficiency and keeping the angle of twist $\alpha$ and the angle $\beta$ of the tapered upstream end face 342*f* relatively small. Thus, above-described inconveniences can be eliminated or reduced.

Further, the screw pitch can be smaller in multi-helix screws, and image failure resulting from unevenness in conveyance of developer can be prevented or reduced. In the case of such a multi-helix screw, load to bearings or seal members can be smaller, thus expanding their useful lives, because it is not necessary to increase the rotational frequency excessively. Moreover, use of such a multi-helix screw can prevent aggregation or solidification of developer caused by increases in temperature. Accordingly, creation of substandard images can be prevented. Additionally, the concentration of toner in the developer on the development roller 302 (developer bearer) can be kept constant, and accordingly image density can be kept constant. Thus, satisfactory image quality can be secured, and operational life of the development device 3 can be expanded.

Figure 13A:
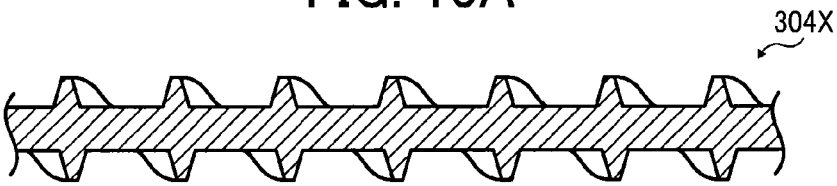
FIG. 13A is a cross-sectional view of a tapered conveyance screw.
Figure 13B:
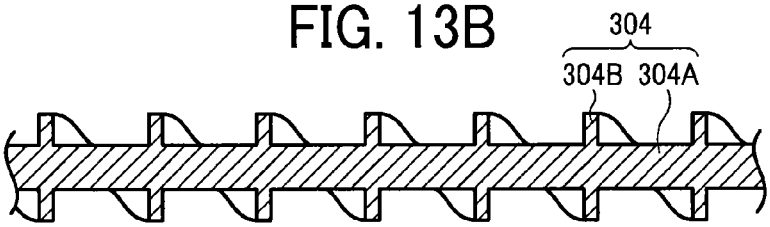
FIG. 13B is a cross-sectional view of a conveyance screw that is not tapered.

FIGS. 13A and 13B illustrate cross sections passing through the center axes of screws applicable as the supply screw 304 in the present embodiment. FIG. 13A is a cross-sectional view of a screw having a tapered spiral blade (hereinafter "tapered screw 304X"), and FIG. 13B is a cross-sectional view of a screw whose spiral blade is not tapered (hereinafter "non-tapered screw").

The supply screw 304 is preferably a non-tapered screw as shown in FIG. 13B. In the case of the non-tapered screw, since the spiral blade of the screw can rather stand than lie down relative to the developer conveyance direction, straightforward movement of developer can be facilitated, and developer conveyance efficiency can increase.

In the development device 3 in which developer that has passed through the development range is collected in the collecting channel 350, the amount of developer decreases on the downstream side in the supply channel 340 in the developer conveyance direction, and it is preferable to increase the developer conveyance velocity in the supply channel 340 downstream in that direction. Therefore, the supply screw 304 is preferably a non-tapered screw having an increased developer conveyance force than tapered screws.

Additionally, the tapered screw 304X has a conveyance face inclined to the outer circumferential direction, and this configuration tends to promote force acting in the direction perpendicular to the axial direction. If the developer adjacent to the tapered upstream end face 342*f* receives the force in the direction perpendicular to the axial direction from the supply screw 304X, it is possible that the developer is pressed against the upstream end face 342*f* and is caused to aggregate. By contrast, in the case of the non-tapered screw 304, the vector of force acting in the direction perpendicular to the axial direction can be reduced, and aggregation of developer can be prevented.

Figure 14A:
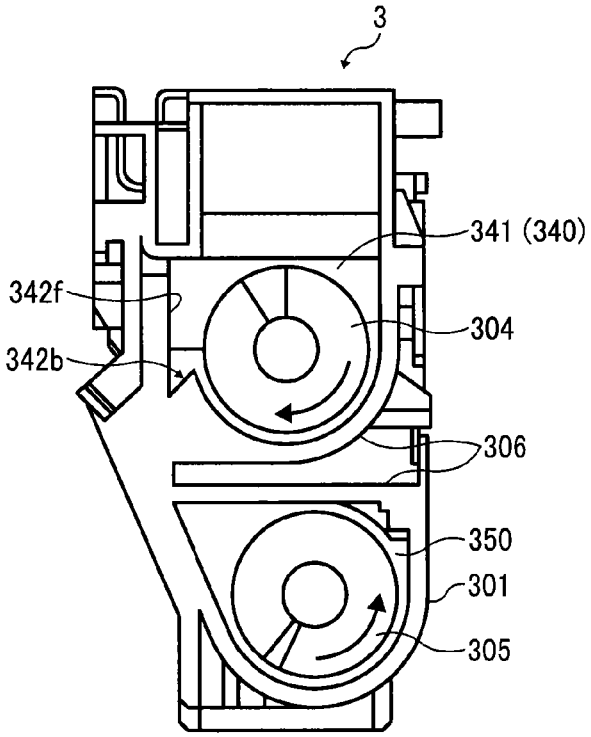
FIG. 14A is an end-on axial view of the development device in which a bottom face on the upstream side of a buffer area is inclined in the direction from a conveyance area to the buffer area.

It is to be noted that, referring to FIGS. 11, 12, and 14A, the bottom face 342*b* that is positioned in the upstream end portion of the buffer area 342 and in contact with the lower end of the upstream end face 342*f* can be either horizontal or inclined.

FIG. 14A is an end-on axial view of the development device 3 in which the bottom face 342*b* (at the upstream end of the buffer area 342) is inclined.

In the configuration shown in FIG. 14A, the bottom face 342*b* descends in the direction from the conveyance area 341 to the buffer area 342 (from the right to the left in FIG. 14A). With such an inclination of the bottom face 342*b*, the developer positioned above the bottom face 342*b*, which does not receive conveyance force directly, can be caused to move toward the buffer area 342 under the gravity.

Figure 14B:
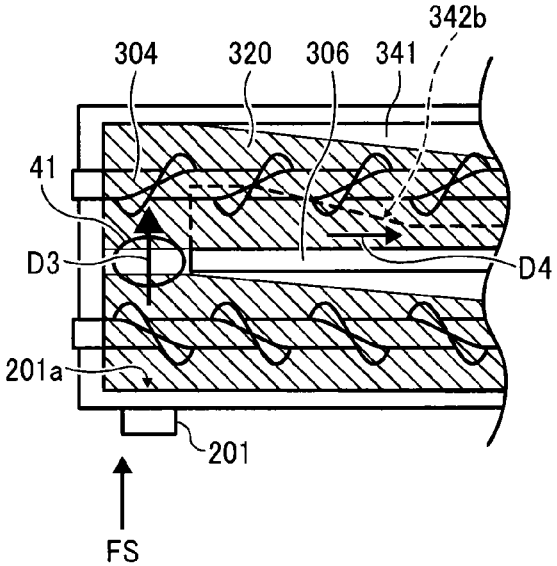
FIG. 14B illustrates a configuration in which the bottom face is inclined downstream in a developer conveyance direction.

FIG. 14B illustrates a configuration in which the bottom face 342*b* is inclined downstream in the developer conveyance direction. With such an inclination of the bottom face 342*b*, the developer positioned above the bottom face 342*b*, which does not receive conveyance force directly, can be caused to move toward the buffer area 342 under the gravity.

Figure 15A:
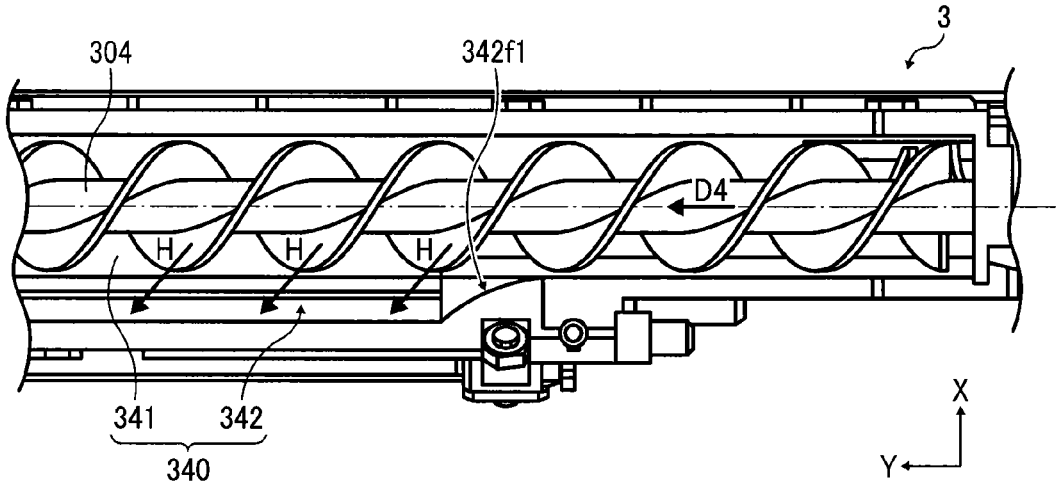
FIGS. 15A and 15B illustrate configurations in which the buffer end face on the upstream side is curved.
Figure 15B:
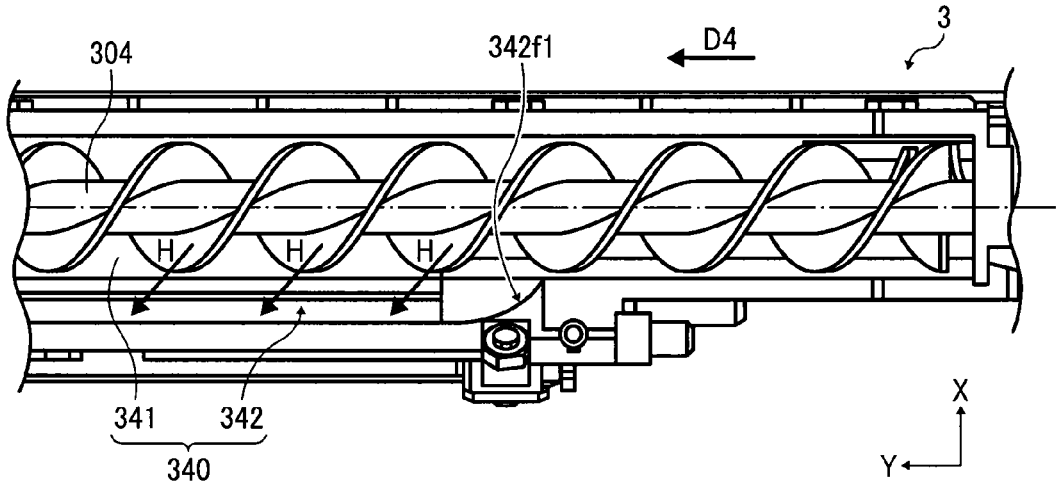

Although the upstream end face 342*f* is tapered, flat, and inclined relative to the axial direction in the above-described configuration, the shaped of the upstream end face 342*f* is not limited thereto as long as the upstream end face 342*f* is inclined to draw away from the conveyance area 341 downstream in the developer conveyance direction. For example, in FIGS. 15A and 15B, the upstream end face 342*f* is curved and given reference character 342*f*1. Forming the upstream end face 342*f* into a tapered flat face as shown in FIG. 5B is advantageous in that the cost for forming the inclined face is not high because tapering is easy.

Although the development device 3 is incorporated in the tandem-type multicolor image forming apparatuses 100 in the above-described embodiment of the present invention, various features according to the present invention can adapt to other types of image forming apparatuses such as single-color image forming apparatuses.

Effects attained by the various configurations of the present inventions are described below.

In configuration A, the development device includes the developer bearer (i.e., development roller 302) disposed facing the latent image bearer (i.e., photoreceptor 1) through an opening formed in the development casing, to carry by rotation developer to the development range facing the latent image bearer, the first developer conveyance member (i.e., supply screw 304) to supply developer to the developer bearer while transporting the developer axially inside the supply channel (340), and the second developer conveyance member (i.e., collecting screw 305) to transport axially developer inside the collecting channel (350) to receive developer from the downstream end portion of the supply channel and to forward the developer to the upstream end portion of the supply channel. The supply channel includes the conveyance area (341) in which the developer receives conveyance force directly from the supply screw 304 and the buffer area (342) adjacent to the conveyance area in the direction perpendicular to the axial direction of the first developer conveyance member. That is, the buffer area may be above or on a side of the conveyance area. The buffer area is positioned such that conveyance force from the first developer conveyance member is not directly exerted on the developer therein. Developer is retained in the buffer area temporarily before being supplied to the developer bearer. The buffer area is positioned midway in the developer conveyance direction inside the supply channel, and the upstream end face defining the upstream end of the buffer area is inclined relative to the axial direction to draw away from the conveyance area downstream in the developer conveyance direction.

This arrangement can facilitate supply of developer to the buffer area and prevent the developer from accumulating and aggregating adjacent to the upstream end face of the buffer area, compared with configurations in which the upstream end face of the buffer area is not inclined but perpendicular to the axial direction.

In configuration B, in addition to the configuration A, the upstream end face defining the upstream end of the buffer area is a flat tapered face. Forming the upstream end face into a tapered flat face is advantageous in that the processing cost can be lower than that for curved faces.

In configuration C, in addition to the configuration B, the first developer conveyance member is a screw including the rotary shaft 304A and the spiral blade 304B winding around the rotary shaft 304A and is designed to transport developer by rotation in the axial direction of the rotary shaft 304A. The angle $\beta$ formed by the upstream end face (i.e., tapered face) of the buffer area and the axial direction, that is, the inclination of the tapered face relative to the axial direction, is smaller than the angle of twist $\alpha$ of the spiral blade of the screw serving as the first developer conveyance member. With this configuration, flow of developer is not inhibited, thus securing prevention of aggregation of developer.

In configuration D, in addition to the configuration C, the first developer conveyance member (supply screw) is multihelical. This configuration is advantageous in that developer conveyance efficiency can increase and that the screw pitch can be smaller, thus preventing substandard images caused by unevenness in conveyance of developer.

In configuration E, in addition to the configuration in C or D, the first developer conveyance member (supply screw) is not tapered. This configuration can facilitate straightforward movement of developer inside the supply channel, thus increasing developer conveyance efficiency.

In configuration F, in any of the configurations A through E, the bottom face (342*b*) of the upstream end portion of the buffer area is inclined, in particular, descends in the direction from the conveyance area toward the buffer area. With this configuration, the developer positioned above the bottom face of the upstream end portion of the buffer area can be caused to move toward the buffer area under the gravity, and the developer can flow smoothly toward the developer bearer.

In configuration G in any of the configurations A through F, the bottom face (342*b*) of the upstream end portion of the buffer area is inclined, in particular, descends downstream in the developer conveyance direction. With this configuration, the developer positioned above the bottom face of the upstream end portion of the buffer area can be caused to move toward the buffer area under the gravity, and the developer can flow smoothly toward the developer bearer.

The image forming apparatus according to configuration H includes at least the latent image bearer such as the photoreceptor 1, the charging unit, the latent image forming device such as the exposure unit 16, and the development device according to any of the configurations A through G. This configuration can attain satisfactory image quality without white lines or density unevenness.

The process cartridge, such as the image forming unit 17, according to configuration I is removably installed in an image forming apparatus and includes at least the latent image bearer, the development device according to any of the configurations A through G, and the common unit casing to house those components, forming an united modular unit. This configuration can attain satisfactory image quality without white lines or density unevenness.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a development casing for containing developer;

a developer bearer disposed facing a latent image bearer to carry by rotation developer to a development range facing the latent image bearer;

a developer conveyance member to supply developer to the developer bearer while transporting the developer axially;

a channel including therein the developer conveyance member, the channel including:

a conveyance area in which the developer conveyance member exerts conveyance force on developer, and a buffer area adjacent to the conveyance area in a direction perpendicular to an axial direction of the developer conveyance member, the buffer area positioned midway in a developer conveyance direction inside the channel and the buffer area being wider than a portion of the channel upstream from the buffer area, an upstream end face being at an upstream end of the buffer area and inclined relative to the axial direction of the developer conveyance member and inclined to a lateral side which is perpendicular to the axial direction to widen the buffer area in the developer conveyance direction.

2. The development device according to claim 1, wherein the upstream end face of the buffer area is a flat tapered face.

3. The development device according to claim 1, wherein a bottom face that is in contact with the upstream end face of the buffer area descends in a direction from the conveyance area toward the buffer area.

4. The development device according to claim 1, wherein a bottom face that is in contact with the upstream end face of the buffer area descends downstream in the developer conveyance direction.

5. A process cartridge removably installed in an image forming apparatus, the process cartridge comprising:

the latent image bearer; and the development device according to claim 1.

6. An image forming apparatus comprising:

a latent image bearer;

a charging device to charge a surface of the latent image bearer;

a latent image forming device to form a latent image on the latent image bearer; and a development device to develop the latent image formed on the latent image bearer, the development device comprising:

a development casing for containing developer;

a developer bearer disposed facing a latent image bearer to carry by rotation developer to a development range facing the latent image bearer;

a developer conveyance member to supply developer to the developer bearer while transporting the developer axially;

a channel including therein the developer conveyance member, the channel including:

a conveyance area in which the developer conveyance member exerts conveyance force on developer, and a buffer area adjacent to the conveyance area in a direction perpendicular to an axial direction of the developer conveyance member, the buffer area positioned midway in a developer conveyance direction inside the channel and the buffer area being wider than a portion of the channel upstream from the buffer area, an upstream end face being at an upstream end of the buffer area and inclined relative to the axial direction of the developer conveyance member and inclined to a lateral side which is perpendicular to the axial direction to widen the buffer area in the developer conveyance direction.

7. The image forming apparatus according to claim 6, wherein the upstream end face of the buffer area is a flat tapered face.

8. The image forming apparatus according to claim 6, wherein a bottom face that is in contact with the upstream end face of the buffer area descends in a direction from the conveyance area toward the buffer area.

9. The image forming apparatus according to claim 6, wherein a bottom face that is in contact with the upstream end face of the buffer area descends downstream in the developer conveyance direction.

* * * * *